US010469973B2

(12) United States Patent
Hayashi et al.

(10) Patent No.: US 10,469,973 B2
(45) Date of Patent: Nov. 5, 2019

(54) SPEAKER ARRAY SYSTEMS

(71) Applicant: BOSE CORPORATION, Framingham, MA (US)

(72) Inventors: Soichiro Hayashi, Tokyo (JP); Akira Mochimaru, Natick, MA (US)

(73) Assignee: BOSE CORPORATION, Framingham, MA (US)

( * ) Notice: Subject to any disclaimer, the term of this patent is extended or adjusted under 35 U.S.C. 154(b) by 0 days.

(21) Appl. No.: 15/581,668

(22) Filed: Apr. 28, 2017

(65) Prior Publication Data

US 2018/0317036 A1 Nov. 1, 2018

(51) Int. Cl.
*H04S 7/00* (2006.01)
*H04R 1/40* (2006.01)
(Continued)

(52) U.S. Cl.
CPC ..... *H04S 7/302* (2013.01); *H04R 1/403* (2013.01); *H04R 3/12* (2013.01); *H04R 5/02* (2013.01); *H04R 5/04* (2013.01); *H04S 3/008* (2013.01); *H04R 2201/401* (2013.01); *H04R 2201/403* (2013.01); *H04R 2203/12* (2013.01);
(Continued)

(58) Field of Classification Search
CPC ..... H04S 7/302; H04S 3/008; H04S 2400/01; H04S 2400/03; H04R 1/403; H04R 3/12; H04R 5/02; H04R 5/04; H04R 2203/12; H04R 2430/01; H04R 2201/401; H04R 2201/403
See application file for complete search history.

(56) References Cited

U.S. PATENT DOCUMENTS 6,128,395 A * 10/2000 De Vries ..... H04R 1/403 381/182
7,260,235 B1 8/2007 Henricksen et al.
(Continued)

FOREIGN PATENT DOCUMENTS

EP 1703773 A2 9/2006
EP 1705955 A1 9/2006
(Continued)

OTHER PUBLICATIONS

Meyer, P., "DSP Beam Steering with Modern Line Arrays", Technical Report, Dec. 2002. Retrieved from: <URL: http://www.meyersound.de/support/papers/beam_steering.pdf> on Jul. 26, 2017.
(Continued)

*Primary Examiner* — Jason R Kurr
(74) *Attorney, Agent, or Firm* — Lando & Anastasi, LLP

(57) ABSTRACT

An array is provided that includes a plurality of drivers, each of the same size and type, to transduce processed audio signals into acoustic waves, an input to receive an audio signal and a control signal, and at least one signal processor to provide the processed audio signals in accord with the received audio signal and the control signal. The signal processor receives the audio signal and the control signal, and provides a first processed signal to a first driver based in part upon the audio signal and a first parameter received from the control signal, and provides a second processed signal to a second driver based in part upon the audio signal and a second parameter received from the control signal.

20 Claims, 4 Drawing Sheets

(51) Int. Cl.

| | |
|---|---|
| ***H04R 3/12*** | (2006.01) |
| ***H04R 5/02*** | (2006.01) |
| ***H04R 5/04*** | (2006.01) |
| ***H04S 3/00*** | (2006.01) |

(52) U.S. Cl.
CPC ..... *H04R 2430/01* (2013.01); *H04S 2400/01* (2013.01); *H04S 2400/13* (2013.01)

(56) References Cited

U.S. PATENT DOCUMENTS

| | | | | |
|---|---|---|---|---|
| 7,577,260 | B1 | 8/2009 | Hooley et al. | |
| 7,936,891 | B2 | 5/2011 | Henricksen et al. | |
| 8,199,925 | B2 | 6/2012 | Konagai | |
| 2005/0041530 | A1 | 2/2005 | Goudie et al. | |
| 2005/0047608 | A1* | 3/2005 | Araya | G10K 15/12 381/63 |
| 2006/0018490 | A1* | 1/2006 | Stiles | H04R 1/26 381/87 |
| 2006/0115101 | A1* | 6/2006 | Schoenberger | H04R 27/00 381/120 |
| 2006/0210093 | A1* | 9/2006 | Ishibashi | H04R 1/403 381/80 |
| 2007/0230724 | A1 | 10/2007 | Konagai et al. | |
| 2009/0060236 | A1 | 3/2009 | Johnston et al. | |
| 2010/0220877 | A1* | 9/2010 | Ishibashi | H04R 1/403 381/170 |
| 2011/0135125 | A1* | 6/2011 | Zhan | H04R 1/403 381/303 |
| 2013/0039512 | A1* | 2/2013 | Miyata | H04R 3/12 381/97 |
| 2013/0089217 | A1 | 4/2013 | Kelloniemi et al. | |
| 2013/0108078 | A1* | 5/2013 | Ma | H04R 3/04 381/103 |
| 2018/0077491 | A1 | 3/2018 | Butler et al. | |
| 2018/0220235 | A1* | 8/2018 | McKinnon | H04R 29/007 |
| 2018/0242097 | A1 | 8/2018 | Kriegel et al. | |

FOREIGN PATENT DOCUMENTS

| | | | |
|---|---|---|---|
| EP | 1760920 | A1 | 3/2007 |
| WO | 2012032335 | A1 | 3/2012 |
| WO | 2017025151 | A1 | 2/2017 |

OTHER PUBLICATIONS

"The JBL Intellivox Range", JBL Professional Brochure, 2015. Retrieved from: <URL: http://www.jblpro.com/ProductAttachments/Intellivox_Brochure.pdf> on Jul. 26, 2017.

"K&F VIDA L and VIDA C", User's Manual, Version 1.8, pp. 1-63, Feb. 21, 2017. Retrieved from: <URL: http://www.kling-freitag.com/content/uploads/man_vida-l_en.pdf> on Jul. 26, 2017.7.

"Pan Beam PB 16—Active Digital Steerable Column Speaker", Pan Acoustics Data Sheet, 2016. Retrieved from: <URL: http://www.pan-acoustics.de/uploads/pics/PA_Datasheet_PB16_ENG_01.pdf> on Jul. 26, 2017.

Goertz, A., "Qflex DSP-controlled Tannoy array with high-end technology", Professional System Test Report, pp. 1-7, Apr. 2009.

"Active Line Array Speaker Systems SR-D8-M, SR-D8-S", TOA Corporation, Installation Manual, pp. 1-36, Retrieved from: <URL: http://www.toaelectronics.com/media/srd8_mi1e.pdf> on Jul. 26, 2017.

"Active Line Array Speaker System SR-D8", TOA Electronics, Inc., pp. 1-4, Retrieved from: <URL: http://www.toaelectronics.com/media/srd8m-cu_cb1e.pdf> on Jul. 26, 2017.

International Search Report and Written Opinion in application No. PCT/US2018/029745 dated Jul. 16, 2018.

International Search Report and Written Opinion in application No. PCT/US2018/029721 dated Jul. 6, 2018.

* cited by examiner

SPEAKER ARRAY SYSTEMS

CROSS REFERENCE TO RELATED APPLICATIONS

This application is related to U.S. patent application Ser. No. 15/581,452 titled ACOUSTIC ARRAY SYSTEMS filed on Apr. 28, 2017, which is incorporated herein by reference in its entirety for all purposes.

TECHNICAL FIELD

Aspects and examples of the present disclosure are directed generally to audio systems, and in some examples, more specifically to audio systems for providing beam steered audio to an audience.

BACKGROUND

Beam steering audio array systems include multiple speaker drivers and control the gain and delay of the signals sent to the drivers so that their combined effect is to direct acoustic energy so that it favors a particular direction, such as toward a central portion of an audience, and so that it provides certain desirable coverage, so that all members of the audience receive an acceptable audio experience, for example. Traditional array systems may include complex or user-unfriendly methods of changing or adapting the beam steering or other acoustic characteristics of the array, and may include drivers of different sizes to handle different portions of the frequency spectrum at additional cost and complexity with reduced reliability.

SUMMARY OF THE INVENTION

Aspects and examples are directed to speaker array systems and methods, and signal processing systems and methods, that provide improved acoustic characteristics, including beam steering and coverage, at lower cost than conventional array systems.

According to one aspect, a speaker array includes an input to receive an audio signal and a control signal, a plurality of drivers, each of the drivers being of the same size and type and configured to transduce processed audio signals into acoustic waves, and at least one signal processor coupled to the input and configured to receive the audio signal and the control signal, and configured to provide a first processed signal to a first driver of the plurality of drivers, the first processed signal based in part upon the audio signal and a first parameter received from the control signal, and to provide a second processed signal to a second driver of the plurality of drivers, the second processed signal based in part upon the audio signal and a second parameter received from the control signal.

The first and second parameters may include at least one of a time delay, a phase delay, an amplitude, a gain, an equalization, and a finite impulse response In some examples, the at least one signal processor includes at least one gain component configured to control, based at least upon the first parameter, an amplitude of the acoustic waves produced by the first driver independent of the amplitude produced by others of the plurality of drivers.

In some examples, the at least one signal processor includes at least one delay component configured to control, based at least upon the first parameter, a delay of the acoustic waves produced by the first driver independent of any delays associated with others of the plurality of drivers.

In certain examples, the processor is configured to provide the first processed signal with a frequency range substantially equal to a frequency range of the audio signal.

According to some examples, the at least one signal processor is configured to provide a distinct processed signal to each of the plurality of drivers, the distinct processed signals based upon the audio signal and a plurality of parameters received from the control signal.

In certain examples, the speaker array includes an output configured to provide the audio signal and at least a portion of the control signal to a further acoustic line array.

In some examples, the at least one processor is configured to provide the first processed signal having a full frequency range to the first driver and the first driver is configured to receive the first processed signal having the full frequency range. In some examples, the full frequency range may include a range of 60 Hz to 18,000 Hz, or may include a range of 100 Hz to 15,000 Hz, or may include a range of 200 Hz to 12,000 Hz.

In some examples, the speaker array is capable of producing on-axis sound pressure level (SPL) in an anechoic environment with a +/−3 dB frequency range of 75 Hz to 13 kHz or better, and a −10 dB frequency range of 58 Hz to 16 kHz or better, with equalization.

The speaker array may include at least twelve drivers. In certain examples the speaker array has exactly twelve drivers.

The drivers may all be of dimension smaller than 3.5 inches. The drivers may all be of a dimension in the range of 2 inches to 3 inches. In certain examples the drivers are approximately 2.5 inches in diameter. In certain examples the drivers are spaced approximately 3 inches apart on center.

The at least one signal processor may include one signal processing channel for each of the plurality of drivers.

In some examples, the signal processor is configured to provide a third processed signal to a third driver. The first, second, and third processed signals may include a first, second, and third delay, respectively, having a non-linear relationship.

According to another aspect, an acoustic array includes an enclosure, an input to receive an audio signal and a control signal, a plurality of acoustic transducers coupled to the enclosure, each of the plurality of acoustic transducers being of the same size and type and configured to transduce processed audio signals into acoustic waves, and at least one signal processor coupled to the input and configured to receive the audio signal and the control signal, and configured to provide a first processed signal to a first acoustic transducer of the plurality of acoustic transducers, the first processed signal based at least in part upon the audio signal and the control signal, and to provide a second processed signal to a second acoustic transducer of the plurality of acoustic transducers, the second processed signal based at least in part upon the audio signal and the control signal.

In some examples, the acoustic array includes at least one gain component configured to control an amplitude of the acoustic waves produced by the first acoustic transducer independent of the amplitude produced by others of the plurality of acoustic transducers.

In some examples, the acoustic array includes at least one delay component configured to control a delay of the acoustic waves produced by the first acoustic transducer independent of any delays associated with others of the plurality of acoustic transducers.

In certain examples, the control signal includes a plurality of parameters, each of the plurality of parameters including at least one of a time delay, a phase delay, an amplitude, a gain, an equalization, and a finite impulse response.

According to some examples, the at least one signal processor is configured to provide the first processed signal having a frequency range substantially equal to a frequency range of the audio signal, and the first acoustic transducer is configured to reproduce a frequency range substantially equal to the frequency range of the audio signal.

In some examples, the at least one signal processor is configured to provide a distinct processed signal to each of the plurality of acoustic transducers, the plurality of distinct processed signals based upon the audio signal and a plurality of parameters received from the control signal.

Certain examples also include an output configured to provide the audio signal and at least a portion of the control signal to a further speaker array.

In some examples, the at least one signal processor is configured to provide the first processed signal having a full frequency range to the first acoustic transducer and the first acoustic transducer is configured to receive the first processed signal having the full frequency range. In some examples, the full frequency range may include a range of 60 Hz to 18,000 Hz, or may include a range of 100 Hz to 15,000 Hz, or may include a range of 200 Hz to 12,000 Hz.

In some examples, the acoustic array is capable of producing on-axis sound pressure level (SPL) in an anechoic environment with a +/−3 dB frequency range of 75 Hz to 13 kHz or better, and a −10 dB frequency range of 58 Hz to 16 kHz or better, with equalization.

The acoustic array may include at least twelve acoustic transducers. In certain examples the acoustic array has exactly twelve acoustic transducers.

The acoustic transducers may all be of dimension smaller than 3.5 inches. The acoustic transducers may all be of a dimension in the range of 2 inches to 3 inches. In certain examples the acoustic transducers are approximately 2.5 inches in diameter. In certain examples the acoustic transducers are spaced approximately 3 inches apart on center.

The at least one signal processor may include one signal processing channel for each of the plurality of drivers.

In some examples, the signal processor is configured to provide a third processed signal to a third acoustic transducer. The first, second, and third processed signals may include a first, second, and third delay, respectively, having a non-linear relationship.

According to another aspect, a method of producing an acoustic sound field is provided and includes receiving an audio signal, receiving one or more array parameters, processing the audio signal to provide a plurality of processed signals in accord with the one or more array parameters, and providing each of the plurality of processed signals to at least one of a plurality of acoustic transducers.

The one or more array parameters may include at least one of a time delay, a phase delay, a gain, an amplitude, an equalization, and a finite impulse response.

In some examples, each of the plurality of processed signals has a frequency range substantially equal to a frequency range of the audio signal. In some examples, the frequency range may include a range of 60 Hz to 18,000 Hz, or may include a range of 100 Hz to 15,000 Hz, or may include a range of 200 Hz to 12,000 Hz.

In some examples, the one or more array parameters include a plurality of delay parameters and processing the audio signal to provide a plurality of processed signals includes delaying the audio signal in accord with the delay parameters.

In some examples, the plurality of acoustic transducers is capable of producing on-axis sound pressure level (SPL) in an anechoic environment with a +/−3 dB frequency range of 75 Hz to 13 kHz or better, and a −10 dB frequency range of 58 Hz to 16 kHz or better, with equalization.

The plurality of acoustic transducers may include at least twelve acoustic transducers. In certain examples the plurality of acoustic transducers has exactly twelve acoustic transducers.

The acoustic transducers may all be of dimension smaller than 3.5 inches. The acoustic transducers may all be of a dimension in the range of 2 inches to 3 inches. In certain examples the acoustic transducers are approximately 2.5 inches in diameter. In certain examples the acoustic transducers are positioned to be spaced approximately 3 inches apart on center.

Some examples include amplifying each of the plurality of processed signals before providing each of the plurality of processed signals to the plurality of acoustic transducers. The one or more array parameters may include a plurality of gain parameters, and amplifying each of the plurality of processed signals may include amplifying each of the processed signals in accord with the gain parameters.

Certain examples include providing the audio signal and at least a portion of the one or more array parameters to a secondary plurality of acoustic transducers.

Still other aspects, examples, and advantages of these exemplary aspects and examples are discussed in detail below. Examples disclosed herein may be combined with other examples in any manner consistent with at least one of the principles disclosed herein, and references to "an example," "some examples," "an alternate example," "various examples," "one example" or the like are not necessarily mutually exclusive and are intended to indicate that a particular feature, structure, or characteristic described may be included in at least one example. The appearances of such terms herein are not necessarily all referring to the same example.

BRIEF DESCRIPTION OF THE DRAWINGS

Various aspects of at least one example are discussed below with reference to the accompanying figures, which are not intended to be drawn to scale. The figures are included to provide illustration and a further understanding of the various aspects and examples, and are incorporated in and constitute a part of this specification, but are not intended as a definition of the limits of the invention. In the figures, identical or nearly identical components illustrated in various figures may be represented by a like numeral. For purposes of clarity, not every component may be labeled in every figure. In the figures.

DETAILED DESCRIPTION

Figure 1:
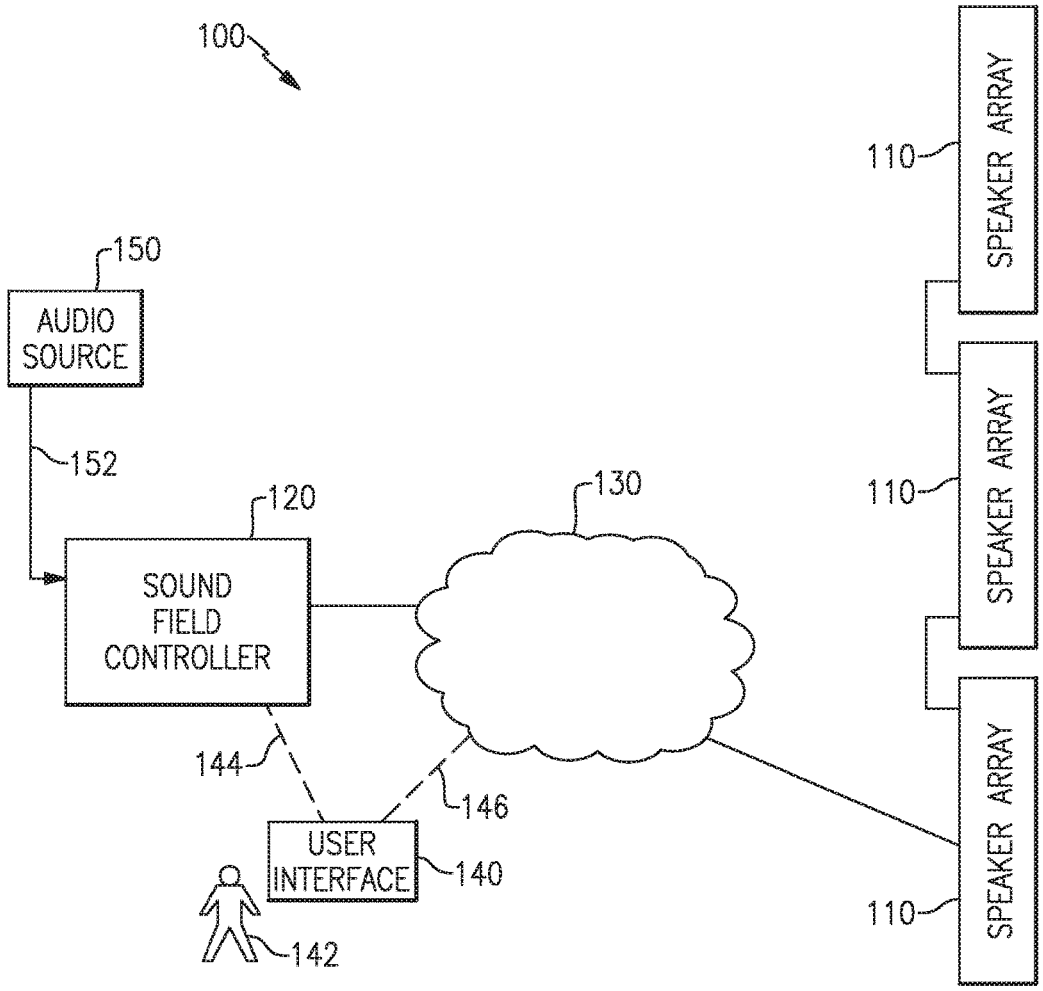
FIG. 1 is a block diagram of an example of an array system.

Aspects of the present disclosure are directed to speaker array systems and methods that include multiple drivers of the same size and type and provide a substantially full range sound field while allowing beam steering and spreading through the application of array parameters to individual drivers. Having drivers of the same size and type to produce substantially full range sound allows the speaker array to have fewer components, cost less, and be more reliable. Moderately sized drivers allow the drivers to be more closely spaced and allow a greater number of drivers within a certain sized enclosure, producing a more accurate sound field at lower cost than conventional arrays having larger drivers to produce lower frequencies.

The speaker array systems disclosed herein may include, in some examples, a speaker array having multiple drivers of the same size and type and having dedicated signal processing and amplifier channels for each of the drivers. The speaker array, through the combined effect of the drivers, produces a sound field having certain characteristics that may include a beam shape, spread, steering, direction, etc., or multiple beams, achieved by application of array (e.g., beam forming) parameters to each of the drivers. Array parameters are applied to each driver by the various signal processing channels and amplifier channels, and include varying delay and gain per driver, as appropriate, and may include finite impulse response filters and equalization. Finite impulse response filters may, for example, apply time delay, phase delay, amplitude, and equalization adjustments, or any combination of these, to each driver.

Examples disclosed herein may be combined with other examples in any manner consistent with at least one of the principles disclosed herein, and references to "an example," "some examples," "an alternate example," "various examples," "one example" or the like are not necessarily mutually exclusive and are intended to indicate that a particular feature, structure, or characteristic described may be included in at least one example. The appearances of such terms herein are not necessarily all referring to the same example.

It is to be appreciated that examples of the methods and apparatuses discussed herein are not limited in application to the details of construction and the arrangement of components set forth in the following description or illustrated in the accompanying drawings. The methods and apparatuses are capable of implementation in other examples and of being practiced or of being carried out in various ways. Examples of specific implementations are provided herein for illustrative purposes only and are not intended to be limiting. Also, the phraseology and terminology used herein is for the purpose of description and should not be regarded as limiting. The use herein of "including," "comprising," "having," "containing," "involving," and variations thereof is meant to encompass the items listed thereafter and equivalents thereof as well as additional items. References to "or" may be construed as inclusive so that any terms described using "or" may indicate any of a single, more than one, and all of the described terms. Any references to front and back, left and right, top and bottom, upper and lower, and vertical and horizontal are intended for convenience of description, not to limit the present systems and methods or their components to any one positional or spatial orientation.

FIG. 1 illustrates an example of an audio system 100 including three speaker arrays 110 interconnected in a daisy-chain arrangement, a sound field controller 120 in communication with the speaker arrays 110 through a network 130, and a user interface 140 from which a user 142 may operate and control various settings and parameters of the speaker arrays 110 to determine characteristics of an acoustic sound field created by the speaker arrays 110. Although three speaker arrays 110 are shown, any number of speaker arrays 110 may be supported, including additional speaker arrays 110 or a single speaker array 110. The sound field controller 120 may be in communication with the speaker arrays 110 through any suitable communications network 130, which may include a direct interface via wireless or wired interconnection or a network infrastructure including one or more routers, switches, and the like. In a certain example, the sound field controller 120 communicates with the speaker arrays 110 by a digital audio networking interface, such as Dante™ by Audinate, Inc., using an Internet Protocol (IP) over any suitable physical layer, e.g., optical, twisted pair, wireless, etc.

The speaker arrays 110 each include a number of drivers, which are electroacoustic transducers that convert an electrical audio signal into an acoustic signal, e.g., an acoustic pressure wave. Each driver's acoustic pressure wave interacts with other drivers' acoustic pressure waves, constructively and destructively interfering at various distances and angles from the speaker array 110, to form a certain acoustic response at each location within a room, and of particular interest at each audience member location within the room. The intensity of the sound at each position in the room, and the intensity variation for different frequencies (e.g., the tone or balance of the sound) is comprehensively referred to herein as a sound field, an acoustic field, or an acoustic sound field.

The sound field controller 120 may receive from an audio source 150 an audio signal 152 that the sound field controller 120 processes and passes to the speaker arrays 110. The sound field controller stores system parameters for processing the audio signal 152, such as system gain, system equalizer, and system delay settings, and stores beam settings such as gain and delay parameters for each of the drivers in the speaker arrays 110. The sound field controller 120 communicates the delay and gain parameters to the speaker arrays 110 via one or more control messages through the communication network 130. For each driver among the speaker arrays 110, a delay and gain applied to the audio signal causes the driver to produce acoustic pressure at the right time and with the right intensity to cause the proper interaction among the acoustic pressure waves to form the intended sound field.

In addition, the sound field controller 120 may store finite impulse response (FIR) parameters for each driver. FIR parameters may be stored in the form of a finite impulse response waveform or may be in the form of FIR filter coefficients that, when applied to a FIR filter, produce an associated response to a filtered audio signal. Finite impulse response parameters may provide desired phase delays for different frequencies that a typical time delay (applied equally to all frequencies) could not, but is not necessarily required in all cases. Additionally, finite impulse response parameters may incorporate each of a time delay common to all frequencies, a gain common to all frequencies, and equalization as desired. In certain examples, however, the delay, gain, and equalization for each driver in the speaker arrays 110 is managed by separate parameters, and FIR parameters are used to fine tune beam steering and spreading and to make frequency-specific adjustment to the same. In certain examples, FIR parameters are optional or not included.

In addition, the sound field controller 120 may store equalization parameters for each driver. The equalization parameters for each driver may include equalization parameters to compensate for a native frequency response of each driver based upon component testing, or the frequency response of each driver in combination with the enclosure and mounting of the driver in the speaker array 110, or the frequency response of the set of all drivers in each speaker array 110, again in combination with the enclosure and mounting of the drivers in the speaker array 110. In the latter case, equalization parameters stored by the sound field controller 120 may be identical for each of the drivers within a single speaker array 110, or for all the drivers among all the speaker arrays 110.

In some examples, the speaker array(s) 110 may receive array parameters and/or equalization in a different manner. For example, the sound field controller 120 in some examples may not store the parameters, or the speaker array(s) 110 may not use the parameters or equalization stored by the sound field controller 120, and may use parameters and/or equalization received from elsewhere, such as from a configuration tool, or as previously pre-loaded equalization and/or array parameters stored in memory associated with the speaker array(s) 110.

The sound field controller 120 has, or may communicate with, a user interface 140 that may include, for example, one or more user input devices such as a keyboard, mouse, touch-sensitive screen, and the like, and may include one or more user output devices, such as a screen, monitor, lights, buzzers, and other indicators, and the like. The user interface 140 may be integrated with the sound field controller 120, or may be remote to the sound field controller 120 via a direct connection 144 or via a network connection 146 through the network 130 or other suitable communications interface(s). For example, the user interface 140 may include a remote computer, workstation, or device, proprietary or non-proprietary, such as a laptop, desktop, tablet, smartphone, etc., and such may have dedicated software that displays user information and options and communicates with the sound field controller 120, or may have general software, such as a web browser, that communicates with the sound field controller 120 via e.g., a web server hosted by the sound field controller 120.

The user interface 140 may allow a user 142 to select a sound field from among multiple pre-loaded sound fields. Additionally, the sound field controller 120 coupled with the user interface 140 may allow creation of new sound fields by the calculation of new array parameters. In general, signal processing channels of the sound field controller 120 and the speaker arrays 110, each discussed in more detail below, process signals to create a desired sound field using array parameters that may include amplitude, gain, time delay, phase delay, equalization, finite impulse response, and other parameters as appropriate to a certain desired sound field. In a certain example, the array parameters applied include amplitude and time delay. In a further example, the array parameters applied also include FIR coefficients.

Such array parameters may be required by the system, e.g., audio system 100, but are generally not "user friendly" in that they are not easily chosen or modified by the user 142. Accordingly, it is desired that the user 142 may work with user friendly parameters that define the desired sound field or beam characteristics, such as beam direction, spreading, tonal balance, and the like. Accordingly, a sound field tool may be incorporated into the sound field controller 120 to allow calculation of array parameters from user-specified sound field parameters. Alternatively, a sound field tool may exist separate from the sound field controller 120, and the audio system 100, and may provide one or more sets of array parameters that may be loaded, programmed, stored, or otherwise used with the audio system 100. In certain examples, the sound field controller 120 may include memory or other storage capability to store such array parameters.

The audio signal 152 is described above as coming from an audio source 150 and processed by the sound field controller 120. Additionally or alternatively, the sound field controller 120 may store one or more portions, or all, of the audio signal 152 to be provided to the speaker arrays 110. In other examples, the audio signal 152 may be provided to the speaker arrays 110 through a different mechanism, such as directly to an audio input associated with one of the speaker arrays 110.

Figure 2:
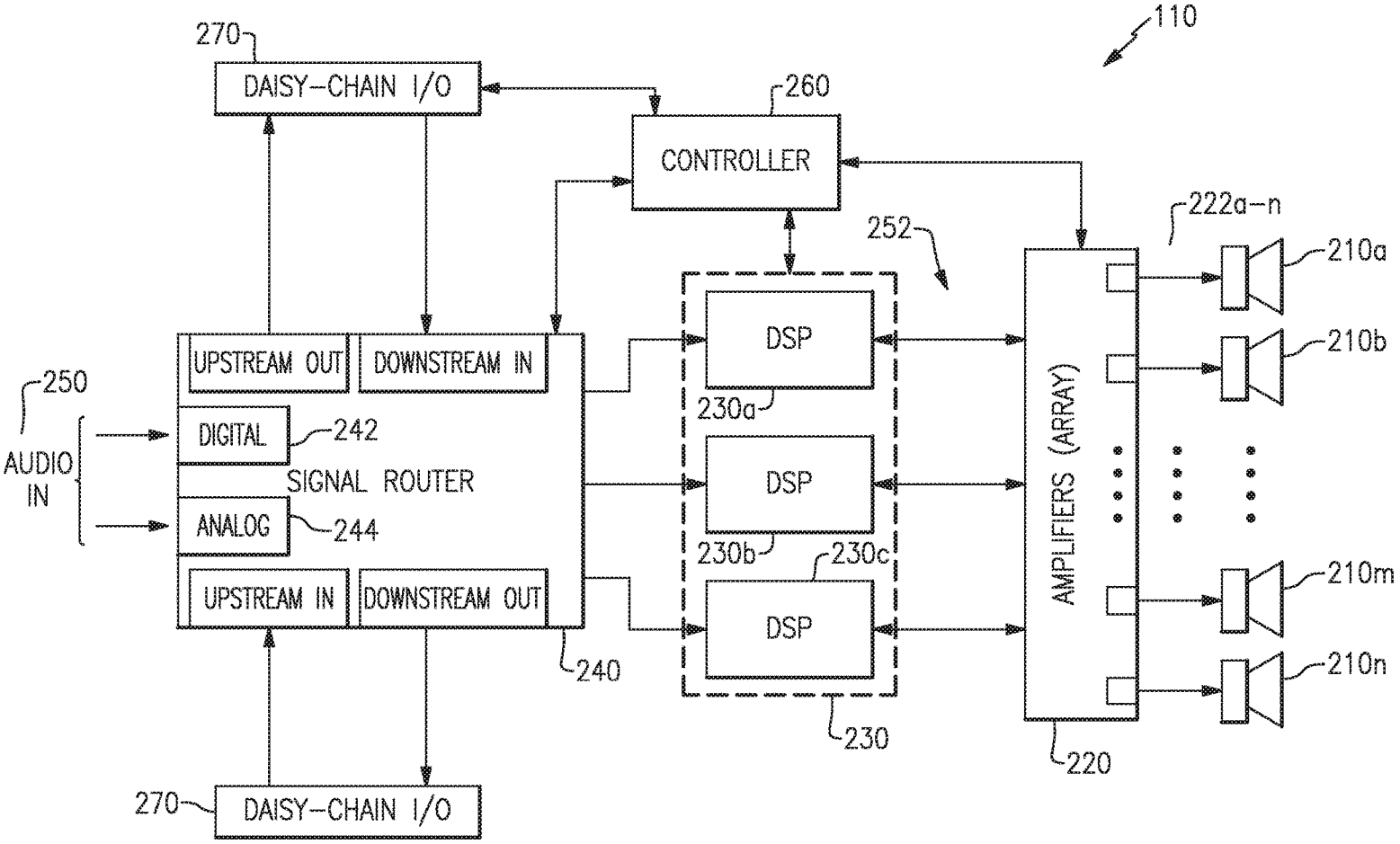
FIG. 2 is a block diagram of an example of a speaker array.

FIG. 2 illustrates an example of a speaker array 110 that includes a number of drivers 210 with an array of amplifiers 220 and a bank of digital signal processors (DSP) 230. A signal router 240 routes an audio signal 250, received at one of a digital interface 242 or an analog interface 244, to the DSP bank 230 which processes the audio signal 250 individually for each driver 210 and provides processed signals 252, one for each driver, to the amplifiers 220. The amplifiers 220 provide an amplified processed signal 222 to each of the drivers 210. A speaker array 110 may have any number of drivers 210, amplifiers 220, and DSP's 230.

In a particular example, a speaker array 110 has twelve drivers 210, twelve amplifiers 220, and three DSP's 230, each having four DSP channels for a total of twelve DSP channels. Accordingly, there is at least one DSP channel and at least one amplifier channel per driver 210 such that each driver 210 may receive a unique amplified processed signal 222 derived from the received audio signal. Each DSP 230 channel applies a delay to the received audio signal 250 to provide the processed signal 252, in accord with a delay parameter communicated from the sound field controller 120. Each DSP 230 channel may also apply equalization in accord with equalization parameters received from the sound field controller 120, and may additionally or alternatively apply pre-stored equalization in accord with pre-stored equalization parameters. Each DSP 230 channel may also apply a gain in accord with a gain parameter received from the sound field controller 120, and may apply a FIR filter in accord with FIR parameters received from the sound field controller 120. In certain examples, gain parameters received from the sound field controller 120 are applied by the amplifiers 220 instead of, or in addition to, the DSP 230 channels.

In certain examples, equalization applied by the DSP 230 channels compensates for a frequency response of the speaker array 110, as discussed above. In certain examples, the sound field controller 120 may apply equalization to the audio signal 152 associated with various frequency responses, such as, for example, to compensate for frequency response of the room in which the speaker array 110 is operated, to compensate for tonal balance or frequency coloring anticipated or resulting from the beam forming process (e.g., gain, delay, FIR filters), and/or to apply a user desired equalization, tone adjustment, or color.

Still referring to FIG. 2, the speaker array 110 may include a controller 260 that communicates with and controls the various components of the speaker array 110. For example, the controller 260 may be a processor that communicates with the sound field controller 120 (via, e.g., digital interface 242) to receive the various array parameters. The controller 260 may load or establish the parameters (e.g., gain, delay, FIR) into the DSP 230 channels and the amplifiers 220. The controller 260 also may control the signal router 240 to select the interface upon which to receive the audio signal 250, e.g., digital 242 or analog 244, and may receive the audio signal 250 from another (e.g., upstream) speaker array 110 and/or provide the audio signal 250 to another (e.g., downstream) speaker array 110 via a daisy-chain input/output interface 270.

Further, the controller 260 may detect the presence of upstream and downstream speaker arrays 110, may receive or provide beam forming or array parameters from/to an upstream or downstream speaker array 110, may communicate with the sound field controller 120 about the presence of upstream and downstream speaker arrays 110, may receive array parameters or other communications for an upstream or downstream speaker array 110 and communicate the parameters to the upstream or downstream speaker array 110, and may receive communication from an upstream or downstream speaker array 110 for the sound field controller 120 and communicate it to the sound field controller 120. In certain examples, the controller 260 may be an integrated component that includes the signal router 240 and/or the interfaces 242, 244, 270, and may include or be incorporated in one or more of the DSP's 230. Any suitable processor with suitable programming, or suitable logic, such as an application specific integrated circuit (ASIC), or programmable gate array, for example, may serve as the controller 260 or a portion thereof.

Conventional speaker arrays include two-way and three-way systems. Two-way systems typically include drivers for mid/bass frequencies and separate drivers for high frequencies. Three-way systems typically include three separate types of drivers, one for bass or low frequencies (e.g., woofers), another for mid-range frequencies, and a third for high frequencies (e.g., tweeters)

In certain examples, the speaker array 110 includes drivers 210 all of the same size and type and does not include any drivers of differing sizes or types. For example, drivers of all the same size and type have substantially the same acoustic characteristics, including frequency response and radiation characteristics. In certain examples, the drivers 210 are all of the same size in the range of 1.5 inches to 6.5 inches. In a particular example, the drivers 210 are all of substantially the same size in the range of 2.0 to 3.5 inches, such as all the drivers 210 being approximately 2.5-inch drivers, for example, each spaced approximately 3 inches apart on center. In certain examples, the drivers 210 are all of substantially the same size of 3 inches or smaller. In other examples, the drivers 210 are all of the same size in the range of 4.0 to 6.0 inches, such as all the drivers 210 being approximately 5-inch drivers, for example. In these examples, there are no crossover components, functions, or features included with the speaker array 110 that would separate out different frequency bands. Crossover features are not necessary in these examples because there are no additional or different drivers to which differing frequency bands are directed.

Each driver 210 included in certain examples of the speaker array 110 is a full range driver. In certain examples the drivers 210 are of moderate size, as discussed above. At least one benefit of single-sized drivers 210 of moderate or relatively small dimension (e.g., 2.5-inch) is that the distance between adjacent drivers 210 may be small relative to drivers of larger scale. The smaller distance between adjacent drivers 210 reduces sidelobes in the vertical acoustic radiation pattern of the speaker array 110, especially at lower frequencies. For example, an array having 2.5-inch drivers spaced 3 inches apart on center exhibits fewer or reduced sidelobes below about 4.5 kHz. Conventional systems use larger drivers to produce low frequencies, requiring further distance between center points and giving rise to undesirable sidelobes. For example, a conventional array having 4-inch drivers spaced 4.8 inches apart on center exhibits more or stronger sidelobes down to 2.8 kHz or lower.

A further benefit of single-sized drivers 210 of moderate dimension is that more drivers 210 may be fit into a certain length, or overall size, of the speaker array 110. Accordingly, for a given structural size of the speaker array, drivers 210 of moderate or small size allow for more acoustic sources, providing an enhanced capability to effect and control the distribution of acoustic energy, i.e., enhanced control of the acoustic sound field by, e.g., beam steering, spreading, etc. A further benefit of single-sized drivers 210 of moderate or small dimension is that they may produce less frequency variation, e.g., fewer and/or moderate peaks and dips in the frequency response, with respect to arrays with larger drivers. This is especially true at mid-range frequencies and in the near field, i.e., close to the speaker array relative to acoustic wavelength. A further benefit of single-sized drivers 210 of moderate dimension is that such reduces the total number of drivers in the speaker array, as opposed to adding drivers for differing frequency ranges. Fewer total drivers simplifies and/or reduces other associated hardware, such as DSP channels, signal switching and routing, amplifiers, etc., which reduces cost and increases reliability. Larger drivers cost more than moderately sized drivers, and multi-way systems require more drivers in total to cover the differing frequency bands, all at added cost. Additionally, a certain number of drivers require a certain size of enclosure and overall structural hardware, such that moderately sized drivers allow for smaller, lighter, safer structures with slimmer profiles and better esthetics.

At least one example of a suitable physical arrangement of single-sized drivers of relatively small dimension is disclosed in U.S. Pat. No. 7,260,235 issued on Aug. 21, 2007, and titled LINE ELECTROACOUSTICAL TRANSDUCING, which is hereby incorporated by reference for all purposes.

In at least one example, the drivers of an array may be staggered such that the centerline of each driver is not aligned with the centerline of adjacent drivers. For example, alternating drivers may be aimed or positioned so that the direction of their maximum radiation pattern is at an angle relative to each other. For reference, the centerline of a driver is the imaginary line normal to the center front surface of the driver's mechanical radiation surface. For further reference, an example of an array with staggered centerlines is disclosed in U.S. Pat. No. 7,936,891 issued on May 3, 2011, and titled LINE ARRAY ELECTROACOUSTICAL TRANSDUCING, which is hereby incorporated by reference for all purposes.

Figure 3:
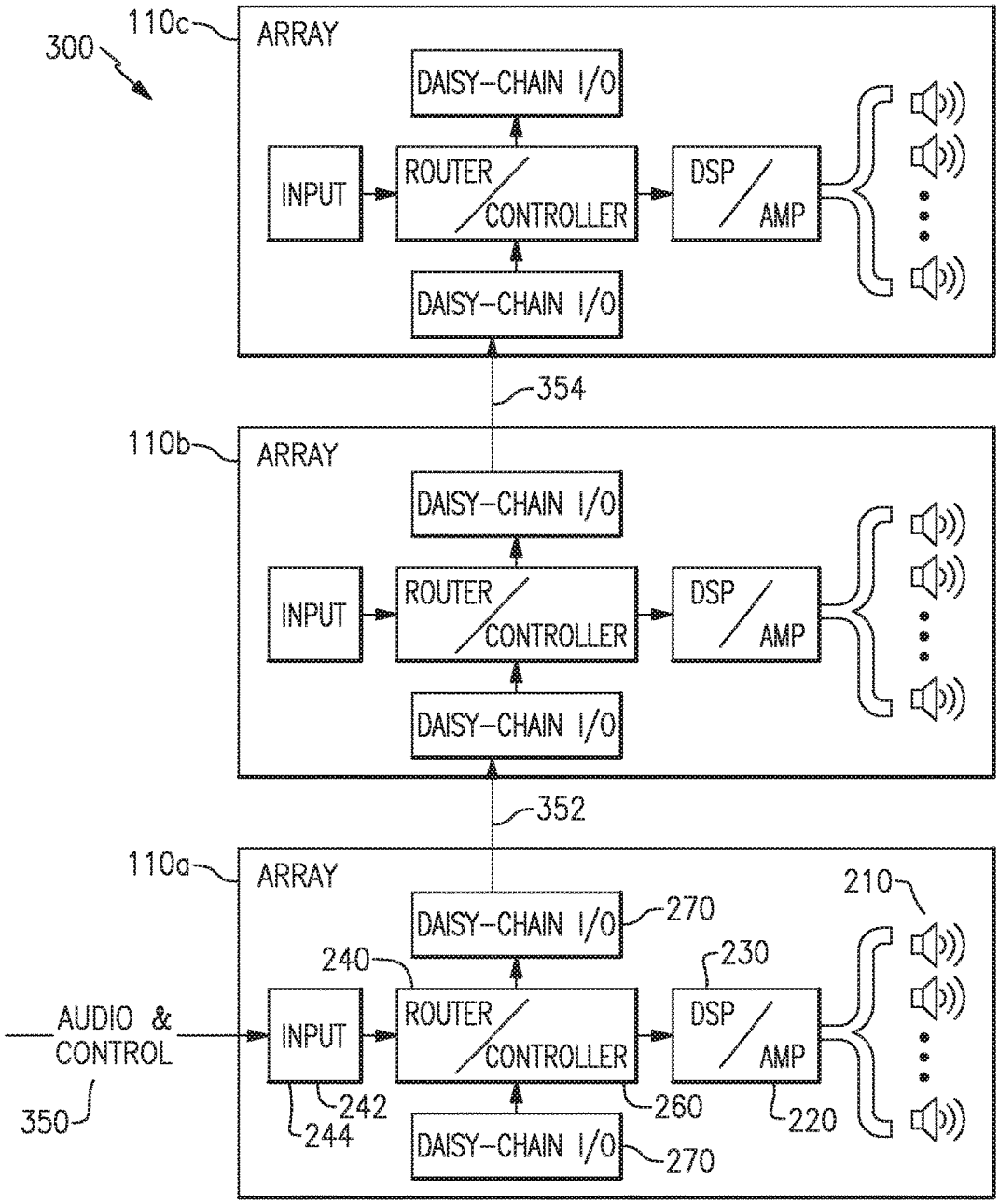
FIG. 3 is a block diagram of an example of a stacked array.

FIG. 3 illustrates a stacked array 300 which is a daisy-chained set of speaker arrays 110. A single speaker array 110 may be used alone, but certain examples of speaker array systems as disclosed herein allow for daisy-chaining two or more speaker arrays 110 to provide a larger array having a greater number of drivers 210, which allows for more extensive control and tailoring of the sound field produced by the stacked array 300 than may be achieved by a single speaker array 110. It should be noted that it may not be necessary to form a stacked array 300 for all applications or in all situations. The ability to form a stacked array 300 may provide increased flexibility to accommodate changing requirements or specific applications. For example, a certain room size or shape may benefit from a stacked array 300 to provide more detailed beam forming, while for a smaller room or different shape a single speaker array 110 may be sufficient.

The stacked array 300 in FIG. 3 includes a first speaker array 110*a*, a second speaker array 110*b*, and a third speaker array 110*c*. Further examples of a stacked array may include only two speaker arrays 110 or may include four or more speaker arrays 110. In the example shown in FIG. 3, the first speaker array 110*a* receives audio and control signals 350, for example as may be received from a sound field controller 120 (see FIG. 1) as discussed above. The first speaker array 110*a* communicates via a daisy-chain connection 352 with the second speaker array 110*b* to pass relevant portions of the audio and control signals 350 to the second speaker array 110*b*. Likewise, the second speaker array 110*b* communicates via a daisy-chain connection 354 with the third speaker array 110*c* to pass relevant portions of the audio and control signals 350 to the third speaker array 110*c*.

Each of the speaker arrays 110 may communicate with each other via the daisy-chain connections 352, 354, and the first speaker array 110*a* may communicate with an audio source (e.g., FIG. 1, audio source 150) or a controller (e.g., FIG. 1, sound field controller 120). In certain examples, each of the speaker arrays 110 may have twelve drivers 210 and the stacked array 300 may therefore include 36 drivers. A sound field controller 120 may store and communicate array parameters, e.g., delay, gain, FIR, equalization, etc. for each driver 210 in the stacked array 300 to produce a selected (e.g., by a user 142) acoustic sound field.

Any of the speaker arrays 110 may be in direct communication with a sound field controller 120 or an audio source 150, and the terms first, second, and third are used arbitrarily in reference to the speaker arrays 110. For example, the second speaker array 110*b* could be in communication with the sound field controller 120 and receive array parameters, e.g., delay, gain, FIR, equalization, etc. for each driver 210 in the stacked array 300 and pass along the relevant parameters to the first speaker array 110*a* and the third speaker array 110*c*, as appropriate. Similarly, the stacked array 300 may be configurable so that any of the three speaker arrays 110 may receive an audio signal and pass the audio signal to the other speaker arrays 110, or each of the speaker arrays 110 may receive an audio signal directly from an audio source. In certain examples, the physical configuration and communication connectivity of the stacked array 300 may be selectable by a user 142 at a user interface 140, or may be automatically discoverable by the various systems (e.g., the speaker arrays 110 and the sound field controller 120), or any combination thereof.

Figure 4:
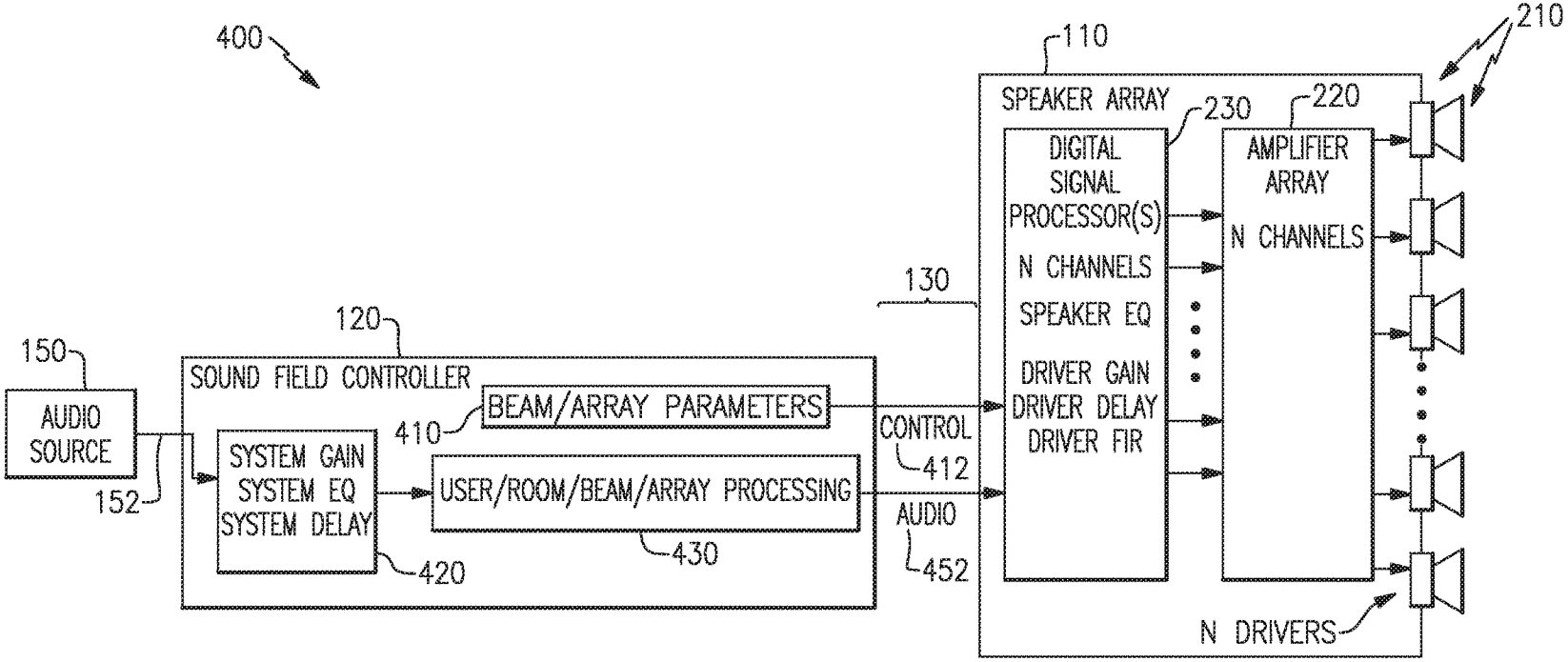
FIG. 4 is a block diagram of another example of an array system.

FIG. 4 illustrates an example of an audio system 400 including at least one speaker array 110 in communication with a sound field controller 120 through a communications channel, such as may be provided through the network 130. The sound field controller 120 stores array parameters 410 for the speaker array 110 and communicates them to the speaker array 110 through one or more control messages 412. The array parameters 410 may include gain, delay, FIR, equalization, and other parameters for each of the drivers 210 that are part of the speaker array 110. It should be noted that the array parameters 410 may include parameters for drivers 210 associated with additional speaker arrays 110 as part of a stacked array, e.g., the stacked array 300 of FIG. 3, and one or more of the speaker arrays 110 may communicate the array parameters 410 through a daisy-chain communication as discussed above.

The array parameters 410 may include parameters for beam controls, e.g., steering, direction, spreading, etc., as part of a user-selected sound field and may generally be referred to as beam parameters, though such parameters may effectuate other aspects of sound field creation other than a beam. Additionally, the array parameters 410 may include other parameters not associated with a particular beam configuration, such as equalization parameters that compensate for the frequency response of the drivers 210 mounted in the speaker array 110.

In certain examples, the sound field controller 120 communicates one set of equalization parameters that the speaker array 110 applies to all the drivers 210, such as a fixed speaker equalization that compensates for the frequency response of the speaker array 110, which may depend upon a model number or type of speaker array 110. In other examples, the sound field controller 120 may communicate different equalization parameters for different drivers 210. For example, drivers 210 at different positions in the speaker array 110 may exhibit different frequency responses and may benefit from different equalization than other drivers 210 in the speaker array 110. Additionally, different user-selected acoustic sound fields may benefit from different equalization in the speaker array 110. Equalization parameters may also be associated with beam control, as a beam pattern may create coloring of the acoustic sound field, i.e., a shifting of frequency response, which may be at least partially compensated by equalization.

The sound field controller 120 may apply processing to the audio signal 152 to produce a processed audio signal 452 that the sound field controller 120 passes to the one or more speaker arrays 110 (e.g., directly or via a daisy-chain). For example, the sound field controller 120 may provide system processing 420 that may include gain, delay, equalization, and the like, that affects all sound being produced by the audio system 400. For example, system gain and delay may be beneficial to adjust the overall sound level and timing to match other speakers in a room. For instance, the audio system 400 may process and generate a sound field for a rear channel among a set of speakers in a room and the timing and level may need to be adjusted to match a front channel, or vice-versa, or for a left-right channel pair, and the like.

Array parameters such as individual gain, delay, FIR, and equalization parameters for each of the drivers 210 may be selected by a sound field design tool that incorporates room characteristics such as shape, size, materials, audience orientation, etc. Such room characteristics may color, i.e., alter the frequency response of, the sound field produced by an acoustic array system, e.g., audio system 400. The sound field controller 120 may apply processing 430 to adjust the audio signal 152 for room characteristics, beam characteristics, or array characteristics that may be at least partially compensated by common processing 430 without regard to individual drivers 210. The altered frequency response due to room characteristics, for example, may be at least partially compensated by room equalization applied in the processing 430. Additional coloring of the sound field may be a side product of the array configuration, e.g., the model of one or more speaker arrays 110 or configuration as a stacked array 300, or a side product of desired beam characteristics, and such may be at least partially compensated by array and/or beam equalization or other adjustments in the processing 430. Additionally, the sound field controller 120 may provide user-selectable options or adjustments to the audio signal, such as equalization, tone, balance, delay, gain, etc, based upon user preferences, and such adjustments may be applied to the audio signal 152 in the processing 430. It should be understood that any characteristic, adjustment, or processing of the audio signal 152 that does not require individual adjustment at one driver 210 separately from another driver 210, may be applied in the sound field controller 120 at either of the processing 430 or the system processing 420. Such processing that commonly applies to all the drivers 210 may be collectively referred to as common processing or system processing.

Among the various examples discussed above reference is made at times to one or more signal processing channels. It should be understood that various signal processing channels may be digital or analog in nature and that specific examples of digital signal processing channels may have analog counterparts substituted therefore, and that analog signal processing may have digital counterparts substituted therefore. It should be understood that conversion of signals from digital to analog, and vice-versa, are well known in the art and such conversion may include one or more digital-to-analog converters (DAC) and/or analog-to-digital converters (ADC), respectively. In the examples discussed above such conversion may be included though the conversion may not be discussed or shown. Those of skill in the art will understand how to make such conversion as necessary to implement the examples discussed. In particular, it should be understood that processing in a sound field controller 120, and in one or more DSP 230 channels of a speaker array 110, may occur in the digital domain while a signal (processed, combined, amplified, etc.) provided to an amplifier or to a driver may be analog. Accordingly, a DAC may be provided between, e.g., a DSP 230 and an amplifier 220, to convert a processed digital signal into an analog signal to be amplified.

Having described above several aspects of at least one example, it is to be appreciated various alterations, modifications, and improvements will readily occur to those skilled in the art. Such alterations, modifications, and improvements are intended to be part of this disclosure and are intended to be within the scope of the invention. Accordingly, the foregoing description and drawings are by way of example only, and the scope of the invention should be determined from proper construction of the appended claims, and their equivalents.

What is claimed is:

1. A speaker array, comprising:

an input to receive an audio signal and a control signal from a sound field controller;

a plurality of drivers, each of the drivers being of the same size and type, and configured to transduce processed audio signals within a frequency range of at least 200 Hz to 12,000 Hz into acoustic waves;

at least one signal processor coupled to the input and configured to receive the audio signal and the control signal, and configured to provide a first processed signal to a first driver of the plurality of drivers, the first processed signal based in part upon the audio signal and a first parameter received from the control signal, and to provide a second processed signal to a second driver of the plurality of drivers, the second processed signal based in part upon the audio signal and a second parameter received from the control signal; and a controller configured to detect a presence of a downstream speaker array connected to the sound field controller through the speaker array, to communicate with the sound field controller about the presence of the downstream speaker array, and to transmit communications from the downstream speaker array to the sound field controller.

2. The speaker array of claim 1 wherein the at least one signal processor includes at least one gain component configured to control, based at least upon the first parameter, an amplitude of the acoustic waves produced by the first driver independent of the amplitude produced by others of the plurality of drivers.

3. The speaker array of claim 1 wherein the at least one signal processor includes at least one delay component configured to control, based at least upon the first parameter, a delay of the acoustic waves produced by the first driver independent of any delays associated with others of the plurality of drivers.

4. The speaker array of claim 1 wherein the first and second parameters each include at least one of a time delay, a phase delay, an amplitude, a gain, an equalization, and a finite impulse response.

5. The speaker array of claim 1 wherein the at least one signal processor is configured to provide the first processed signal having a frequency range substantially equal to a frequency range of the audio signal.

6. The speaker array of claim 1 wherein the at least one signal processor is configured to provide a distinct processed signal to each of the plurality of drivers, each of the distinct processed signals based upon the audio signal and a plurality of parameters received from the control signal.

7. The speaker array of claim 1 further comprising an output configured to provide the audio signal and at least a portion of the control signal to a further acoustic line array.

8. An acoustic array, comprising:

an enclosure;

an input to receive an audio signal and a control signal from a sound field controller;

a plurality of acoustic transducers coupled to the enclosure, each of the plurality of acoustic transducers being of the same size and type, and configured to transduce processed audio signals within a frequency range of at least 200 Hz to 12,000 Hz into acoustic waves;

at least one signal processor coupled to the input and configured to receive the audio signal and the control signal, and configured to provide a first processed signal to a first acoustic transducer of the plurality of acoustic transducers, the first processed signal based at least in part upon the audio signal and the control signal, and to provide a second processed signal to a second acoustic transducer of the plurality of acoustic transducers, the second processed signal based at least in part upon the audio signal and the control signal; and a controller configured to detect a presence of a downstream acoustic array connected to the sound field controller through the acoustic array, to communicate with the sound field controller about the presence of the downstream acoustic array, and to transmit communications from the downstream acoustic array to the sound field controller.

9. The acoustic array of claim 8 wherein the at least one signal processor includes at least one gain component configured to control an amplitude of the acoustic waves produced by the first acoustic transducer independent of the amplitude produced by others of the plurality of acoustic transducers.

10. The acoustic array of claim 8 wherein the at least one signal processor includes at least one delay component configured to control a delay of the acoustic waves produced by the first acoustic transducer independent of any delays associated with others of the plurality of acoustic transducers.

11. The acoustic array of claim 8 wherein the control signal includes a plurality of parameters, each of the plurality of parameters including at least one of a time delay, a phase delay, an amplitude, a gain, an equalization, and a finite impulse response.

12. The acoustic array of claim 8 wherein the at least one signal processor is configured to provide the first processed signal having a frequency range substantially equal to a frequency range of the audio signal, and the first acoustic transducer is configured to reproduce a frequency range substantially equal to the frequency range of the audio signal.

13. The acoustic array of claim 8 wherein the at least one signal processor is configured to provide a distinct processed signal to each of the plurality of acoustic transducers, each of the distinct processed signals based upon the audio signal and a plurality of parameters received from the control signal.

14. The acoustic array of claim 8 further comprising an output configured to provide the audio signal and at least a portion of the control signal to a further speaker array.

15. A method of producing an acoustic sound field, the method comprising:

receiving an audio signal and one or more array parameters from a sound field controller at a first acoustic array;

processing the audio signal at the first acoustic array to provide a plurality of processed signals in accord with the one or more array parameters;

providing each of the plurality of processed signals to at least one of a plurality of acoustic transducers in the first acoustic array, each of the plurality of acoustic transducers being of the same size and type and being configured to transduce signals within a frequency range of at least 200 Hz to 12,000 Hz;

transducing, by the plurality of acoustic transducers, each of the plurality of processed signals into an acoustic signal;

detecting, with a controller of the first acoustic array, a presence of a downstream acoustic array connected to the sound field controller through the first acoustic array;

transmitting a communication from the controller of the first acoustic array to the sound field controller about the presence of the downstream acoustic array; and transmitting communications from the downstream acoustic array from the controller of the first acoustic array to the sound field controller.

16. The method of claim 15 wherein the one or more array parameters include at least one of a time delay, a phase delay, a gain, an amplitude, an equalization, and a finite impulse response.

17. The method of claim 15 wherein the one or more array parameters include a plurality of delay parameters and processing the audio signal to provide a plurality of processed signals includes delaying the audio signal in accord with the delay parameters.

18. The method of claim 15 further comprising amplifying each of the plurality of processed signals before providing each of the plurality of processed signals to the at least one of the plurality of acoustic transducers.

19. The method of claim 18 wherein the one or more array parameters include a plurality of gain parameters and amplifying each of the plurality of processed signals includes amplifying each of the processed signals in accord with the gain parameters.

20. The method of claim 15 further comprising providing the audio signal and at least a portion of the one or more array parameters to a secondary plurality of acoustic transducers.

* * * * *